US007633368B2

(12) United States Patent
Lee

(10) Patent No.: US 7,633,368 B2
(45) Date of Patent: Dec. 15, 2009

(54) ON-CHIP INDUCTOR

(75) Inventor: Sheng-Yuan Lee, Taipei (TW)

(73) Assignee: Via Technologies, Inc., Taipei (TW)

( * ) Notice: Subject to any disclaimer, the term of this patent is extended or adjusted under 35 U.S.C. 154(b) by 31 days.

(21) Appl. No.: 11/758,695

(22) Filed: Jun. 6, 2007

(65) Prior Publication Data

US 2008/0079527 A1 Apr. 3, 2008

(30) Foreign Application Priority Data

Oct. 2, 2006 (TW) ..... 95136539 A

(51) Int. Cl.
*H01F 5/00* (2006.01)

(52) U.S. Cl. ..... 336/200

(58) Field of Classification Search ..... 336/65, 336/83, 200, 206–208, 232; 257/531
See application file for complete search history.

(56) References Cited

U.S. PATENT DOCUMENTS 6,380,835 B1 4/2002 Lee
6,480,086 B1 * 11/2002 Kluge et al. ..... 336/200
6,794,977 B2 * 9/2004 Christensen ..... 336/200
6,967,555 B2 * 11/2005 Yu et al. ..... 336/200
7,317,354 B2 * 1/2008 Lee ..... 330/200
7,370,403 B1 * 5/2008 Hsu et al. ..... 29/602.1
2005/0258508 A1 11/2005 Sakamoto

FOREIGN PATENT DOCUMENTS

CN 1288240 3/2001

OTHER PUBLICATIONS

English Abstract of CN1288240.

* cited by examiner

*Primary Examiner*—Tuyen Nguyen
(74) *Attorney, Agent, or Firm*—Thomas, Kayden, Horstemeyer & Risley

(57) ABSTRACT

An inductor comprises first and second winding portions symmetrically arranged in an insulating layer on a substrate. Each of the first and second winding portions comprises at least two semicircular conductive traces concentrically arranged. At least one of the relatively outer semicircular conductive traces has a cross section smaller than at least one of the relatively inner semicircular conductive traces.

12 Claims, 7 Drawing Sheets

ON-CHIP INDUCTOR

BACKGROUND OF THE INVENTION

1. Field of the Invention

The invention relates to semiconductor integrated circuits and in particular to an on-chip inductor in differential operation.

2. Description of the Related Art

Many digital and analog elements and circuits have been successfully applied to semiconductor integrated circuits. Such elements may include passive components, such as resistors, capacitors, or inductors. Typically, a semiconductor integrated circuit includes a silicon substrate. One or more dielectric layers are disposed on the substrate, and one or more metal layers are disposed in the dielectric layers. The metal layers may be employed to form on-chip elements, such as on-chip inductors, by current semiconductor technologies. For on-chip inductor design, wireless communication chip designs more frequently employ differential circuits to reduce common mode noise, with inductors applied therein symmetrically.

As integrated circuit (IC) designs have progressed, there has been an increased interest in integrating several different functions on a single chip while minimizing process complexity and any resulting impact on manufacturing yield. This integration of several different functions on a single chip is known as system on chip (SOC). Additionally, with the rapid development of communication systems, an SOC typically includes radio frequency (RF) circuits and digital or baseband circuits. Since the RF circuits in a SOC are smaller than the digital or baseband circuits, chip fabrication employs a digital or baseband circuit process. Accordingly, the traces of inductors in SOC are thinner compared to the inductors of general RF circuits, resulting in reduction of quality factor (Q value). However, the signals with phase difference of 180° may pass through the adjacent traces of the inductor in differential operation, resulting in increase of parasitic capacitance. Thus, Q value cannot be increased by narrowing the space between traces of the inductor.

Since it is a trend of integrated circuit (IC) design to integrate different functions into a single chip, there is a need to develop an on-chip inductor with increased Q value.

BRIEF SUMMARY OF INVENTION

A detailed description is given in the following embodiments with reference to the accompanying drawings.

An on-chip inductor is provided. An embodiment of an inductor comprises first and second winding portions symmetrically arranged in an insulating layer on a substrate. Each of the first and second winding portions comprises at least two semicircular conductive traces concentrically arranged. At least one of the relatively outer semicircular conductive traces has a cross section smaller than at least one of the relatively inner semicircular conductive traces.

Another embodiment of an on-chip inductor comprises first and second winding portions symmetrically arranged in an insulating layer on a substrate and electrically connected to each other. Each of the first and second winding portions comprises first, second and third semicircular conductive lines concentrically arranged from inside to outside, wherein the second semicircular conductive line has the widest line width.

Another embodiment of an on-chip inductor for a semiconductor circuit comprising a substrate, an insulating layer disposed thereon and a plurality of conductive layers successively disposed in the insulating layer comprises first and second winding portions symmetrically arranged in the insulating layer and electrically connected to each other. Each of the first and second winding portions comprises at least two semicircular conductive traces concentrically arranged, wherein the outermost semicircular conductive trace has a cross section smaller than at least one of the relatively inner semicircular conductive traces.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is provided for the purpose of illustrating the general principles of the invention and should not be taken in a limiting sense. The scope of the invention is best determined by reference to the appended claims. The on-chip inductor of the invention will be described in the following with reference to the accompanying drawings.

Figure 1A:
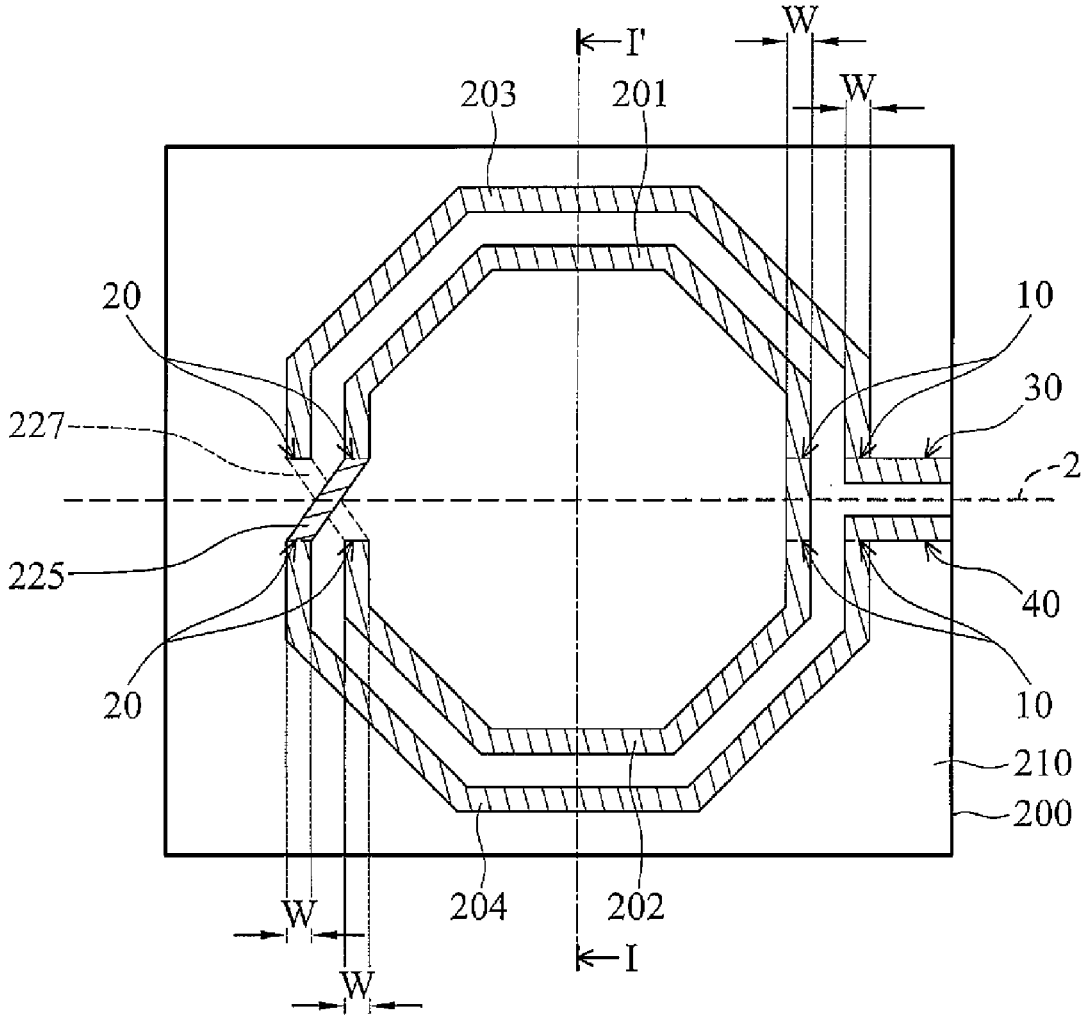
FIG. 1A is a plan view of an embodiment of a two-turn on-chip inductor.
Figure 1B:
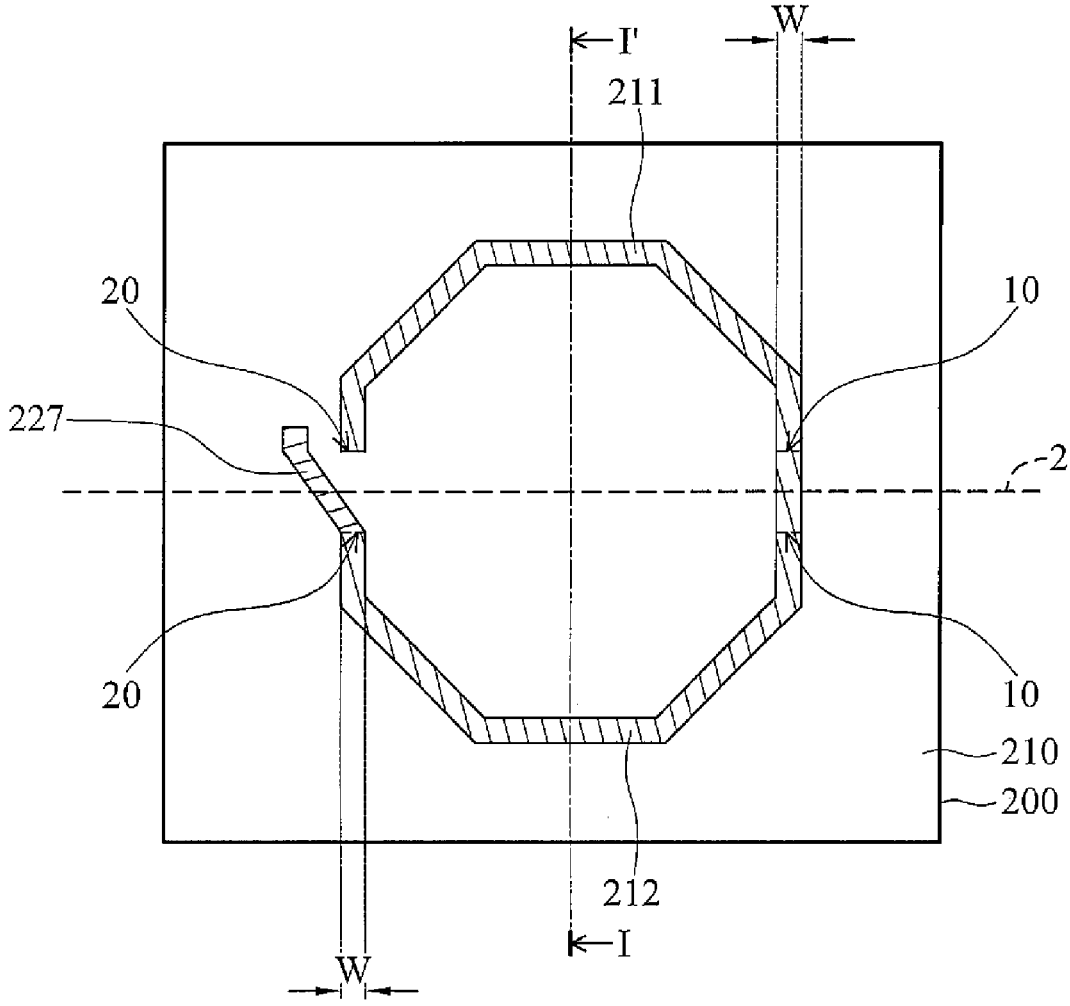
FIG. 1B is a plan view of a multilayer structure of the on-chip inductor shown in FIG. 1A.
Figure 1C:
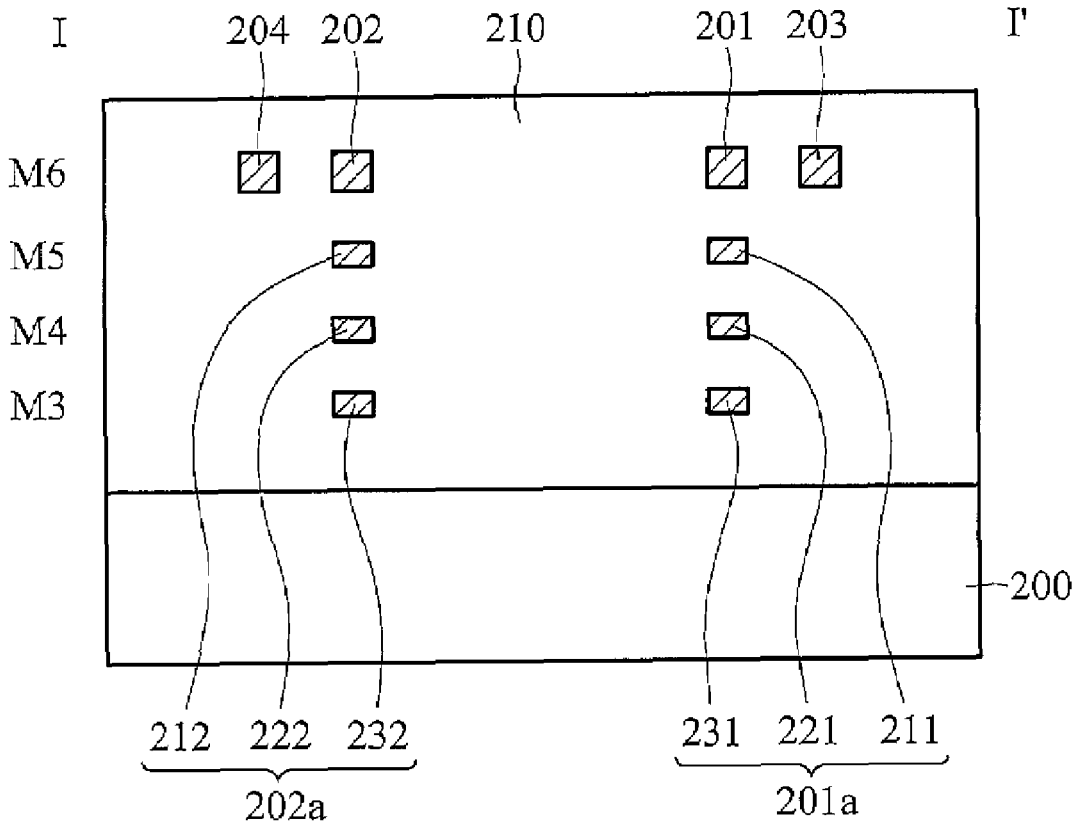
FIG. 1C is a cross section along I-I' line shown in FIG. 1A.

Referring to FIGS. 1A to 1C, in which FIG. 1A is a plan view of an embodiment of a two-turn on-chip inductor, FIG. 1B is a plan view of a multilayer structure of the on-chip inductor shown in FIG. 1A and FIG. 1C is a cross section along I-I' line shown in FIG. 1A. The on-chip inductor may be implemented in a semiconductor circuit. The semiconductor circuit may comprise a substrate 200, an insulating layer 210 disposed on the substrate 200, and a plurality of conductive layers successively disposed in the insulating layer 210. The substrate 200 may include a silicon substrate or other known semiconductor substrate. The substrate 200 may include various elements, such as transistors, resistors, or other well-known semiconductor elements. Moreover, the substrate 200 may also include other conductive layers (e.g. copper, aluminum, or alloy thereof) and insulating layers (e.g. silicon oxide, silicon nitride, or low-k dielectric material). Hereinafter, to simplify the diagram, only a flat substrate is depicted. Additionally, the insulating layer 210 may be a single low-k dielectric layer or multilayer dielectric. For example, multilayer dielectric and the plurality of conductive layers are alternately arranged on the substrate 200. In this embodiment, the insulating layer 210 may include silicon oxide, silicon nitride, or low-k dielectric material.

As shown in FIG. 1A, the on-chip inductor comprises first and second winding portions. The first winding portion is disposed in the insulating layer 210 and located at a first side of dashed line 2. The first winding portion may comprise two semicircular conductive traces arranged in concentricity from inside to outside. The relatively outer semicircular conductive trace may comprise a semicircular uppermost conductive line 203 formed by, for example, defining a first conductive layer (i.e. an uppermost conductive layer) of the plurality of conductive layers in the insulating layer 210. The relatively inner semicircular conductive trace comprises a semicircular uppermost conductive line 201 and the underlying multilayer structure 201*a*, as shown in FIGS. 1B and 1C. Also, the semicircular uppermost conductive line 201 formed by, for example, defining the first conductive layer (i.e. the uppermost conductive layer) of the plurality of conductive layers in the insulating layer 210. The semicircular uppermost conductive lines 201 and 203 have substantially the same thickness and line width. The multilayer structure 201*a* is electrically connected to the semicircular uppermost conductive line 201 through at least one conductive plug (not shown) and comprises a plurality of semicircular conductive layers overlapped and separated from each other and a plurality of conductive plugs (not shown) electrically connected to therebetween. In order to simplify the diagram, only three semicircular conductive lines (or layers) 211, 221 and 231 are depicted. The semicircular conductive lines 211, 221 and 231 can be formed by defining various conductive layers, such as second, third and fourth conductive layers under the uppermost conductive layer in the insulating layer 210. Note that the number of conductive layers in the multilayer structure is based on circuit design.

The second winding portion is disposed in the insulating layer 210 and located at a second side opposite to the first side of dashed line 2. The second winding portion may comprise two semicircular conductive traces arranged in concentricity from inside to outside. The second winding portion and the first winding portion are symmetrical with respect to the dashed line 2. The relatively outer semicircular conductive trace may comprise a semicircular uppermost conductive line 204 formed by, for example, defining a first conductive layer (i.e. an uppermost conductive layer) of the plurality of conductive layers in the insulating layer 210. The relatively inner semicircular conductive trace comprises a semicircular uppermost conductive line 202 and the underlying multilayer structure 202*a*, as shown in FIGS. 1B and 1C. Also, the semicircular uppermost conductive line 202 is formed by, for example, defining the first conductive layer (i.e. the uppermost conductive layer) of the plurality of conductive layers in the insulating layer 210. The semicircular uppermost conductive lines 202 and 204 have substantially the same thickness and line width. The multilayer structure 202*a* is electrically connected to the semicircular uppermost conductive line 202 through at least one conductive plug (not shown) and comprises a plurality of semicircular conductive lines (or layers) 212, 222 and 232 overlapped and separated from each other and a plurality of conductive plugs (not shown) electrically connected to therebetween. The semicircular conductive lines 212, 222 and 232 can be formed by defining various conductive layers, such as the second, third and fourth conductive layers under the uppermost conductive layer in the insulating layer 210.

In this embodiment, "cross section" refers to an area of the semicircular conductive trace perpendicular to the direction of the current in the inductor. Moreover, each semicircular conductive line has substantially the same line width W and substantially the same thickness. Since the relatively inner semicircular conductive traces comprise multilayer structures 201*a* and 202*a*, the cross sections of the relatively outer semicircular conductive traces are smaller than those of the relatively inner semicircular conductive traces. Here, the multilayer structures of the relatively inner semicircular conductive traces are utilized for reduction of conductor loss, thereby increasing the Q value of the inductor while maintaining the thickness of the semicircular uppermost conductive line. The relatively outer semicircular conductive trace is formed of a single semicircular uppermost conductive line, thus reduction in Q value or the reduction of usable range of operation frequency due to parasitic capacitance between the conductive traces and the substrate can be prevented.

The first and second winding portions may surround a central portion and be symmetrically arranged. The central portion may be circular, rectangular, hexagonal, octagonal, or polygonal. Hereinafter, to simplify the diagram, only an exemplary octagonal shape is depicted. The semicircular uppermost conductive lines 201, 202, 203 and 204 have a first end 10 and a second end 20. In this embodiment, the first end 10 of the semicircular uppermost conductive line 201 is electrically connected to that of the semicircular uppermost conductive line 202. Moreover, the first ends 10 of the semicircular uppermost conductive lines 203 and 204 have lateral extending portions 30 and 40, respectively, for inputting/outputting differential signals (not shown).

In this embodiment, to maintain geometric symmetry, the second end 20 of the semicircular uppermost conductive line 203 is electrically connected to that of the semicircular uppermost conductive line 202 by a lower cross-connect 227, in which the lower cross-connect 227 can be formed by extending the semicircular conductive line 212, as shown in FIG. 1B. Conductive plugs (not shown) are correspondingly disposed on both ends of the lower cross-connect 227 to electrically connect the semicircular uppermost conductive lines 203 and 202. Additionally, the second end 20 of the semicircular uppermost conductive line 201 is electrically connected to that of the semicircular uppermost conductive line 204 by an upper cross-connect 225, in which the upper cross-connect 225 can be formed by extending the semicircular uppermost conductive line 201 or 204, as shown in FIG. 1A. In some embodiments, the semicircular uppermost conductive line 203 can be electrically connected to that of the semicircular uppermost conductive line 202 by an upper cross-connect, and the second end 20 of the semicircular uppermost conductive line 201 can be electrically connected to that of the semicircular uppermost conductive line 204 by a lower cross-connect.

Figure 2A:
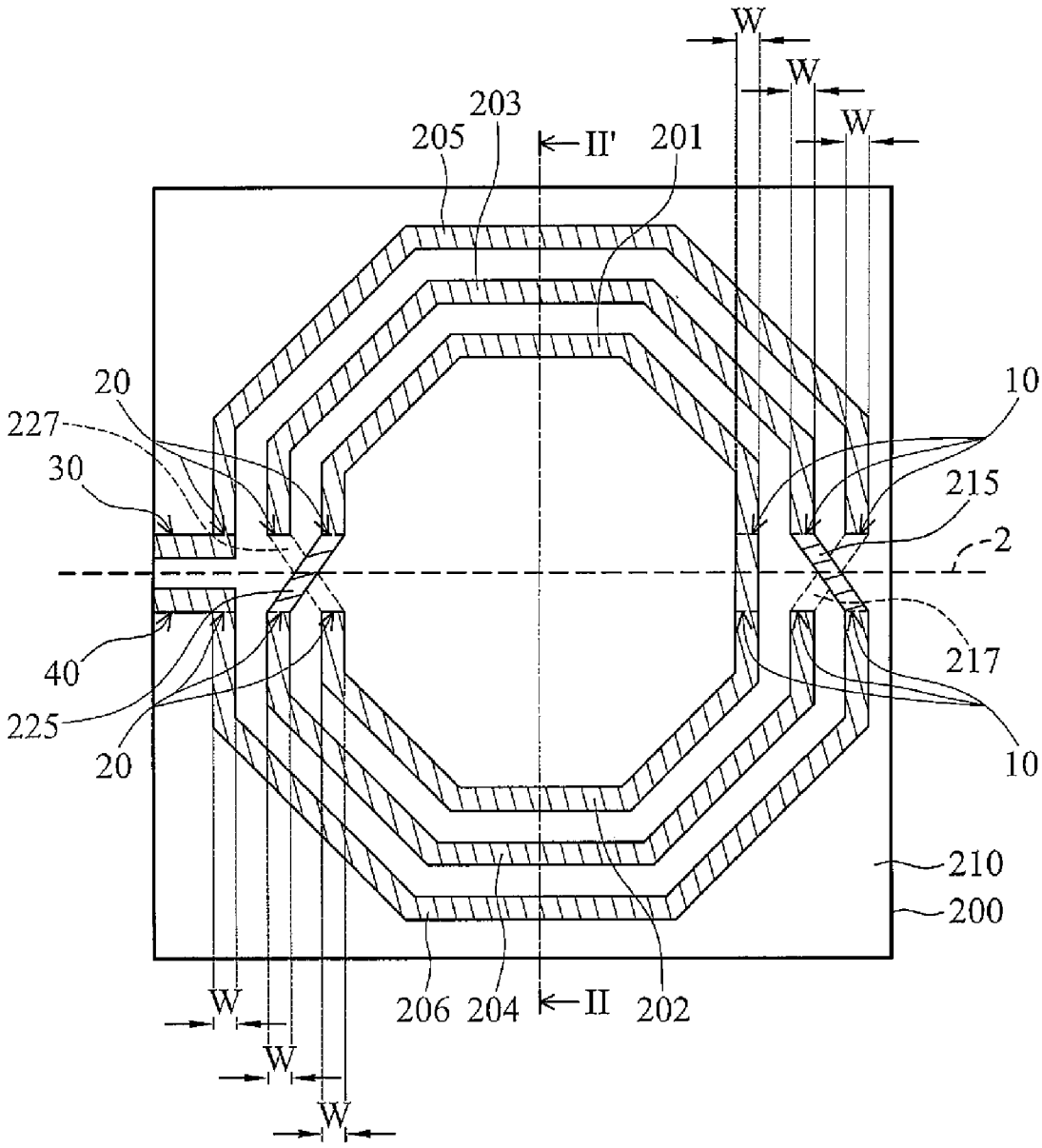
FIG. 2A is a plan view of an embodiment of a three-turn on-chip inductor.
Figure 2B:
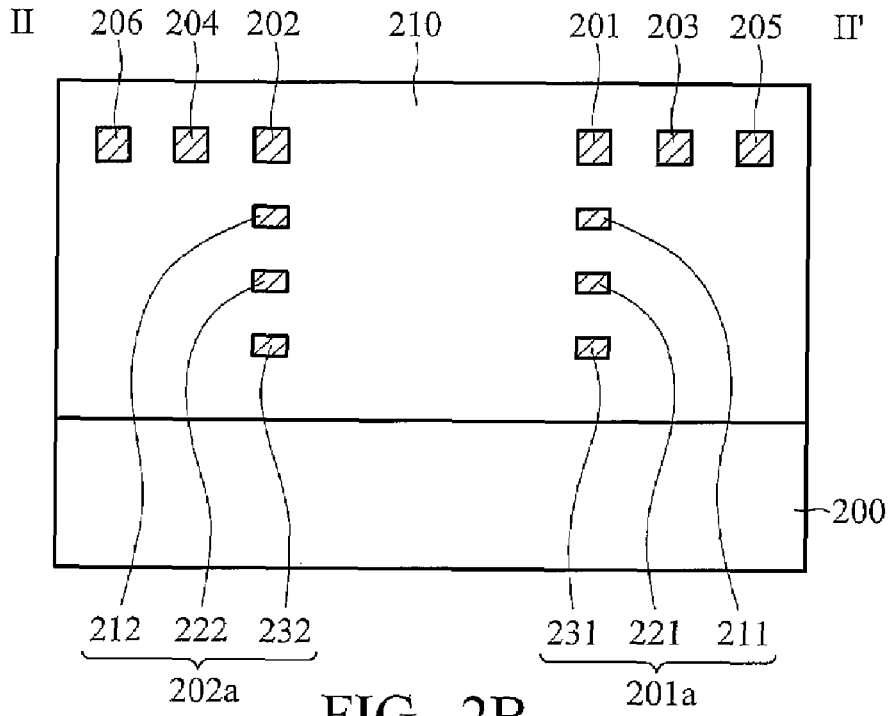
FIG. 2B is a cross section along I-I' line shown in FIG. 2A.
Figure 2C:
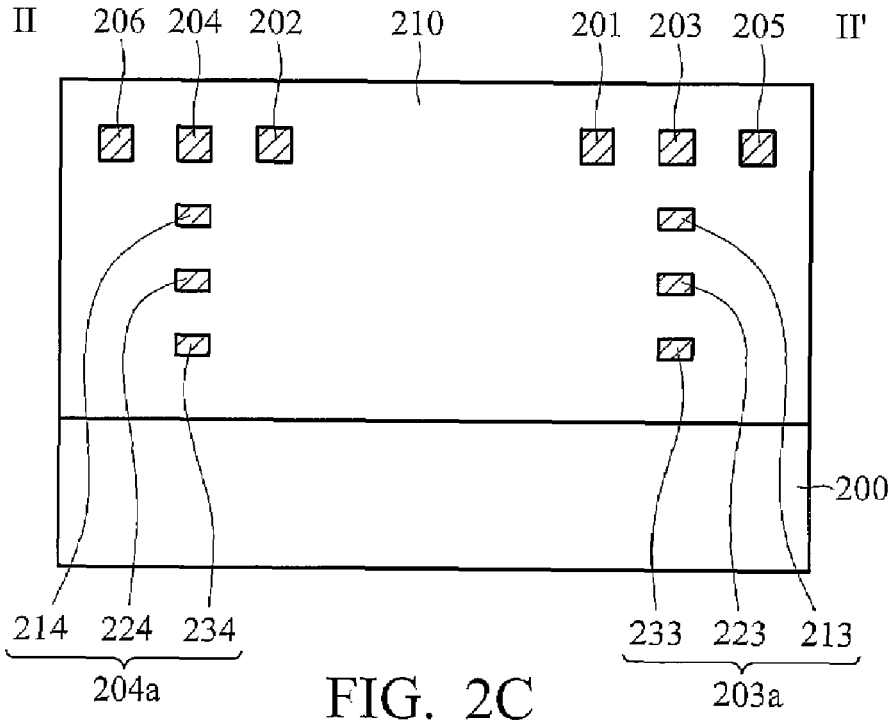
FIG. 2C is a cross section along I-I' line shown in FIG. 2A.
Figure 2D:
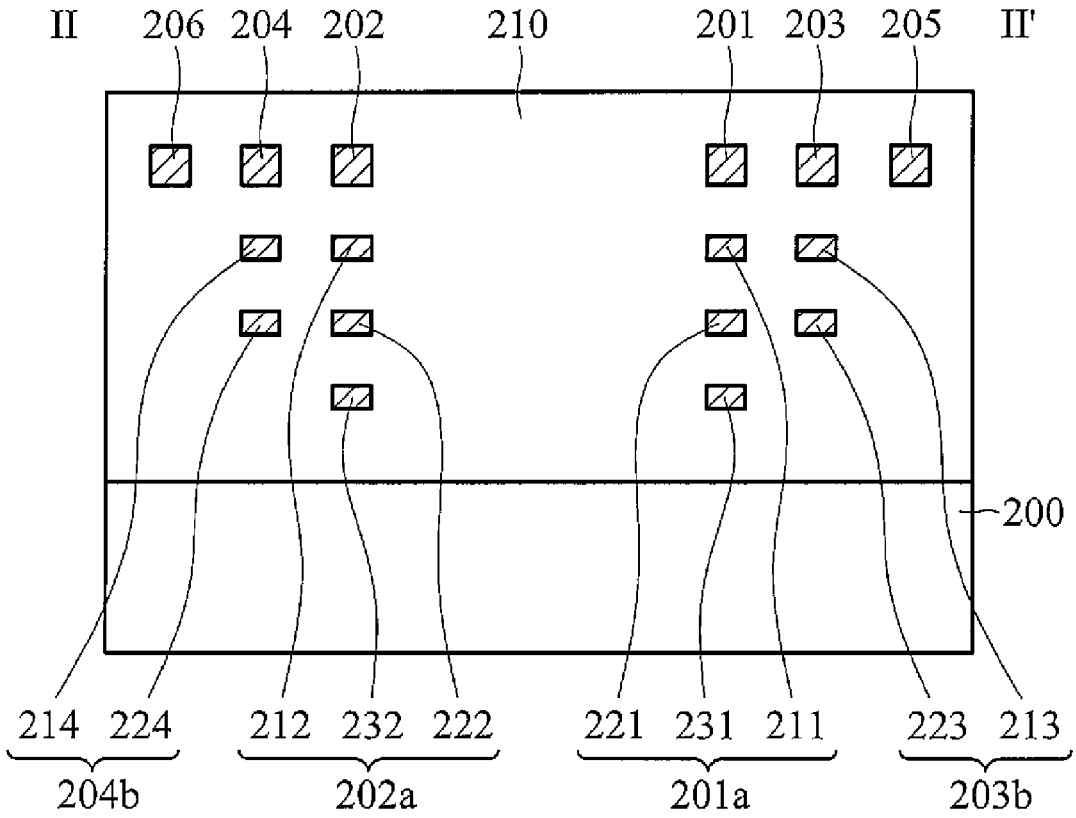
FIG. 2D is a cross section along I-I' line shown in FIG. 2A.

Referring to FIGS. 2A to 2D, in which FIG. 2A is a plan view of an embodiment of a three-turn on-chip inductor, FIG. 2B is a cross section along I-I' line shown in FIG. 2A, FIG. 2C is a cross section along I-I' line shown in FIG. 2A and FIG. 2D is a cross section along I-I' line shown in FIG. 2A. Elements in FIGS. 2A to 2D the same as those in FIGS. 1A to 1C bear the same reference numbers and are not described in detail again. As shown in FIGS. 2A and 2B, first and second winding portions may comprise three semicircular conductive traces arranged in concentricity from inside to outside, respectively. The outermost semicircular conductive traces of the first and second winding portions are respectively formed by semicircular uppermost conductive lines 205 and 206. The middlemost semicircular conductive traces of the first and second winding portions are respectively formed by semicircular uppermost conductive lines 203 and 204. The innermost semicircular conductive trace of the first winding portion is formed by a semicircular uppermost conductive line 201 and a multilayer structure 201*a* thereunder and that of the second winding portion is formed by a semicircular uppermost conductive line 202 and a multilayer structure 202*a* thereunder. That is, in this embodiment, the innermost semicircular conductive traces have the largest cross section.

In some embodiments, the outermost semicircular conductive traces of the first and second winding portions are respectively formed by semicircular uppermost conductive lines 205 and 206. The middlemost semicircular conductive trace of the first winding portion is formed by a semicircular uppermost conductive line 203 and a multilayer structure 203*a* thereunder and that of the second winding portion is formed by a semicircular uppermost conductive line 204 and a multilayer structure 204*a* thereunder. The innermost semicircular conductive traces of the first and second winding portions are respectively formed by semicircular uppermost conductive lines 201 and 202, as shown in FIG. 2C. The multilayer structure 203*a* is electrically connected to the semicircular uppermost conductive line 203 through at least one conductive plug (not shown) and comprises a plurality of semicircular conductive layers (or lines) 213, 223 and 233 overlapped and separated from each other and a plurality of conductive plugs (not shown) electrically connected thereto. Moreover, the multilayer structure 204*a* is electrically connected to the semicircular uppermost conductive line 204 through at least one conductive plug (not shown) and comprises a plurality of semicircular conductive layers (or lines) 214, 224 and 234 overlapped and separated from each other and a plurality of conductive plugs (not shown) electrically connected thereto. The plurality of semicircular conductive layers 213, 223 and 233 and the plurality of semicircular conductive layers 214, 224 and 234 can be formed by defining various conductive layers, such as the second, third and fourth conductive layers under the uppermost conductive layer in the insulating layer 210. Accordingly, in this embodiment, the middlemost semicircular conductive traces have the largest cross section.

In some embodiments, the outermost semicircular conductive traces of the first and second winding portions are respectively formed by semicircular uppermost conductive lines 205 and 206. The middlemost semicircular conductive trace of the first winding portion is formed by a semicircular uppermost conductive line 203 and a multilayer structure 203*b* thereunder and that of the second winding portion is formed by a semicircular uppermost conductive line 204 and a multilayer structure 204*b* thereunder. The innermost semicircular conductive trace of the first winding portion is formed by a semicircular uppermost conductive line 201 and a multilayer structure 201*a* thereunder and that of the second winding portion is formed by a semicircular uppermost conductive line 202 and a multilayer structure 202*a* thereunder, as shown in FIG. 2D. The multilayer structure 203*b* is electrically connected to the semicircular uppermost conductive line 203 through at least one conductive plug (not shown) and comprises a plurality of semicircular conductive layers (or lines) 213 and 223 overlapped and separated from each other and a plurality of conductive plugs (not shown) electrically connected thereto. Moreover, the multilayer structure 204*b* is electrically connected to the semicircular uppermost conductive line 204 through at least one conductive plug (not shown) and comprises a plurality of semicircular conductive layers (or lines) 214 and 224 overlapped and separated from each other and a plurality of conductive plugs (not shown) electrically connected thereto.

Moreover, the number of the conductive layers respectively in multilayer structures 203*b* and 204*b* is different from that respectively in multilayer structures 201*a* and 202*a*. That is, in this embodiment, the cross sections of the semicircular conductive traces gradually increase in size from outside to inside.

As mentioned, the multilayer structures are utilized for reduction of conductor loss, thereby increasing the Q value of the inductor while maintaining the thickness of the semicircular uppermost conductive line. Moreover, the outermost semicircular conductive trace is formed of a single semicircular uppermost conductive line, thus reduction in Q value or usable range of operation frequency due to parasitic capacitance between the conductive traces and the substrate can be prevented. Additionally, as each winding portion comprises more than three semicircular conductive traces arranged in concentricity, the outermost semicircular conductive trace has the smallest cross section and the innermost or middlemost semicircular conductive trace has the largest cross section, such that the cross sections of the semicircular conductive traces also gradually increase in size from outside to inside.

As shown in FIG. 2A, in this embodiment, the second ends 20 of the first and second semicircular uppermost conductive lines 205 and 206 have lateral extending portions 30 and 40, respectively, for inputting/outputting differential signals (not shown). Moreover, the first end 10 of the semicircular uppermost conductive line 205 is electrically connected to that of the semicircular uppermost conductive line 204 by a lower cross-connect 217, in which the lower cross-connect 217 can be formed by extending the semicircular conductive line 214. Conductive plugs (not shown) are correspondingly disposed on both ends of the lower cross-connect 217 to electrically connect the semicircular uppermost conductive lines 205 and 204. Additionally, the first end 10 of the semicircular uppermost conductive line 203 is electrically connected to that of the semicircular uppermost conductive line 206 by an upper cross-connect 215, in which the upper cross-connect 215 can be formed by extending the semicircular uppermost conductive line 204 or 205. In some embodiments, the first end 10 of the semicircular uppermost conductive line 205 can be electrically connected to that of the semicircular uppermost conductive line 204 by an upper cross-connect, and the first end 10 of the semicircular uppermost conductive line 203 can be electrically connected to that of the semicircular uppermost conductive line 206 by a lower cross-connect.

Figure 3:
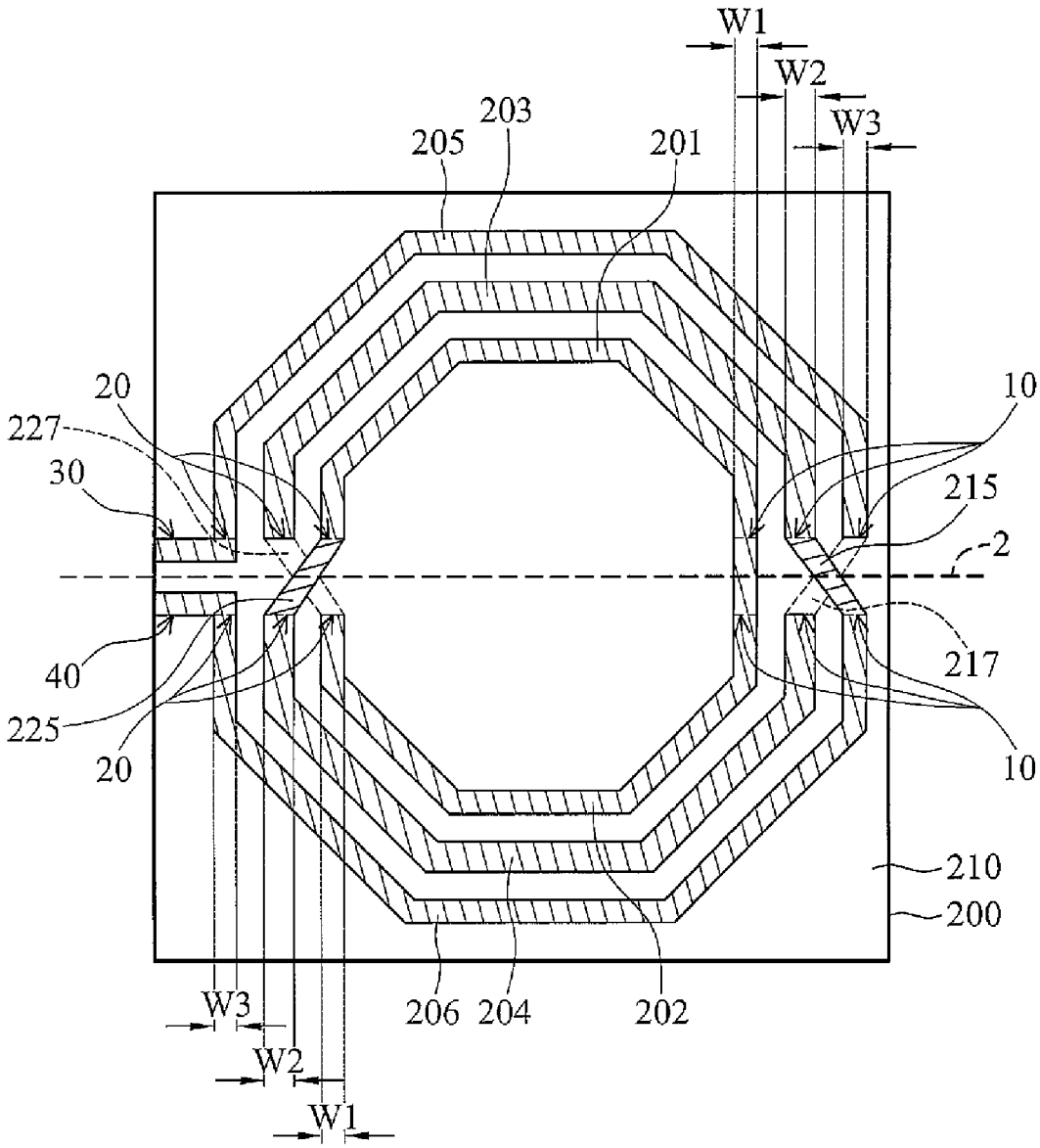
FIG. 3 is a plan view of another embodiment of a three-turn symmetrical inductor.

FIG. 3 is a plan view of an embodiment of a three-turn on-chip inductor. Elements in FIG. 3 the same as those in FIG. 2A bear the same reference numbers and are not described in detail again. As shown in FIG. 3, a first winding portion may comprise semicircular uppermost conductive lines 201, 203 and 205 arranged in concentricity from inside to outside and a second winding portion may comprise semicircular uppermost conductive lines 202, 204 and 206 arranged in concentricity from inside to outside. Each semicircular uppermost conductive line has substantially the same thickness. Moreover, the semicircular uppermost conductive lines 201 and 202 have a line width W1, the semicircular uppermost conductive lines 203 and 204 have a line width W2 and the semicircular uppermost conductive lines 205 and 206 have a line width W3. In this embodiment, the line width W2 exceeds the line widths W1 and W3. Additionally, the line width W1 may substantially equal to the line width W3. Thus, the middlemost semicircular conductive lines 203 and 204 have the largest cross section. Compared to the three-turn on-chip inductor with the same conductive line width, the conductor loss of the on-chip inductor with different conductive line widths can be reduced, thereby increasing the Q value of the inductor while maintaining the thickness of the semicircular uppermost conductive line. Additionally, as each winding portion comprises more than three semicircular conductive traces arranged in concentricity, the middlemost semicircular conductive trace has the largest cross section.

Accordingly, in the invention, since the conductor loss of some traces can be compensated by increasing the line width of the traces or disposing multilayer structures, the Q value of the on-chip inductor can be increased while maintaining the thickness of the semicircular uppermost conductive line.

Accordingly, the Q value of the inductor can be effectively increased for RF circuits of SOPs.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An on-chip inductor, comprising:

an insulating layer disposed on a substrate; and first and second winding portions symmetrically arranged in the insulating layer and electrically connected to each other, each winding portion comprising at least two semicircular conductive traces concentrically arranged;

wherein at least one of the relatively outer semicircular conductive traces has a cross section smaller than at least one of the relatively inner semicircular conductive traces;

wherein the relatively inner semicircular conductive trace comprises:

a first semicircular uppermost conductive line; and a first multilayer structure beneath the first semicircular uppermost conductive line and electrically connected thereto, comprising a plurality of conductive layers overlapped and separated from each other and a plurality of conductive plugs electrically connected to the plurality of conductive layers.

2. The on-chip inductor as claimed in claim 1, wherein the relatively outer semicircular conductive trace comprises a second semicircular uppermost conductive line having substantially the same line width and thickness as the first semicircular uppermost conductive line.

3. The on-chip inductor as claimed in claim 2, wherein the relatively outer semicircular conductive trace further comprises a second multilayer structure beneath the second semicircular uppermost conductive line and electrically connected thereto, and the number of the conductive layers of the second multilayer structure is less than that of the first multilayer structure.

4. The on-chip inductor as claimed in claim 1, wherein the outermost semicircular conductive trace has the smallest cross section.

5. The on-chip inductor as claimed in claim 1, wherein each of the first and second winding portions further comprises:

second and third semicircular uppermost conductive lines concentrically arranged from inside to outside; and a second multilayer structure beneath the second semicircular uppermost conductive line and electrically connected thereto, the second multilayer structure comprising a plurality of conductive layers overlapped and separated from each other and a plurality of conductive plugs electrically connected to the plurality of conductive layers, wherein the number of the conductive layers of the second multilayer structure is different from that of the first multilayer structure.

6. The on-chip inductor as claimed in claim 5, wherein there are fewer conductive layers in the second multilayer structure than that the first multilayer structure.

7. The on-chip inductor as claimed in claim 5, wherein the third semicircular uppermost conductive line has a cross section smaller than the first semicircular uppermost conductive line.

8. The on-chip inductor as claimed in claim 5, wherein the third semicircular uppermost conductive line has a cross section smaller than the second semicircular uppermost conductive line, and the second semicircular uppermost conductive line has a cross section smaller than the first semicircular uppermost conductive line.

9. The on-chip inductor as claimed in claim 5, wherein the first, second and third semicircular conductive uppermost lines have substantially the same line width and substantially the same thickness.

10. An on-chip inductor for a semiconductor circuit, the semiconductor circuit comprising a substrate, an insulating layer disposed thereon and a plurality of conductive layers successively disposed in the insulating layer, and the on-chip inductor comprises:

first and second winding portions symmetrically arranged in the insulating layer and electrically connected to each other, each of the first and second winding portions comprising at least two semicircular conductive traces concentrically arranged;

wherein the outermost semicircular conductive trace has a cross section smaller than at least one of the relatively inner semicircular conductive traces;

wherein the relatively inner semicircular conductive trace comprises:

a first semicircular conductive line formed by defining a first conductive layer of the plurality of conductive layers;

a second semicircular conductive line formed by defining a second conductive layer of the plurality of conductive layers and overlapping the first semicircular conductive line; and at least one conductive plug electrically connected between the first and second semicircular conductive lines.

11. The on-chip inductor as claimed in claim 10, wherein the relatively outer semicircular conductive trace comprises a third semicircular conductive line formed by defining the first conductive layer of the plurality of conductive layers.

12. The on-chip inductor as claimed in claim 11, wherein the relatively outer semicircular conductive trace further comprises a fourth semicircular conductive line formed by defining the second conductive layer of the plurality of conductive layers and overlapping the third semicircular conductive line, and the relatively inner semicircular conductive trace further comprises a fifth semicircular conductive line formed by defining a third conductive layer of the plurality of conductive layers and overlapping the first semicircular conductive line.

* * * * *